US006491031B2

(12) United States Patent
Duda et al.

(10) Patent No.: US 6,491,031 B2
(45) Date of Patent: Dec. 10, 2002

(54) VACUUM BREATHER ASSEMBLY

(75) Inventors: Mark A. Duda, Washington Twp., MI (US); Ben Arndt, Canton, MI (US)

(73) Assignee: BorgWarner Inc., Troy, MI (US)

( * ) Notice: Subject to any disclaimer, the term of this patent is extended or adjusted under 35 U.S.C. 154(b) by 0 days.

(21) Appl. No.: 09/939,305

(22) Filed: Aug. 24, 2001

(65) Prior Publication Data

US 2002/0069863 A1 Jun. 13, 2002

Related U.S. Application Data

(60) Provisional application No. 60/227,864, filed on Aug. 24, 2000.

(51) Int. Cl.[7] ..... F02B 47/08; F02M 25/07

(52) U.S. Cl. ..... 123/568.29; 123/568.3

(58) Field of Search ..... 123/568.29, 568.3, 123/568.31, 568.32

(56) References Cited

U.S. PATENT DOCUMENTS

| | | | | | |
|---|---|---|---|---|---|
| 3,834,366 | A | * | 9/1974 | Kingsbury | 123/568.29 |
| 3,999,737 | A | * | 12/1976 | Hashiguchi et al. | 123/568.29 |
| 4,071,006 | A | * | 1/1978 | Harada | 123/568.29 |
| 4,373,496 | A | * | 2/1983 | Bradshaw | 123/568.29 |
| 4,531,498 | A | * | 7/1985 | Bradshaw | 123/568.29 |
| 4,953,518 | A | * | 9/1990 | Killion et al. | 123/568.29 |
| 5,351,669 | A | * | 10/1994 | Herzog | 123/568.29 |
| 5,749,563 | A | * | 5/1998 | Hosaka et al. | 123/568.29 |

* cited by examiner

*Primary Examiner*—Paul J. Hirsch
(74) *Attorney, Agent, or Firm*—Warn, Burgess & Hoffmann, P.C.; Greg Dziegielewski

(57) ABSTRACT

A baffle assembly for connection to the intake of an exhaust gas recirculation valve. The baffle assembly has a central intake chamber which is protected from the inflow of contaminants. The baffle assembly provides drain paths for any water or contaminants which may get into the inner chamber.

21 Claims, 7 Drawing Sheets

VACUUM BREATHER ASSEMBLY

This application is based on and claims priority of U.S. Provisional Patent Application Serial No. 60/227,864, filed on Aug. 24, 2000.

BACKGROUND OF THE INVENTION

The present invention relates to the venting of EGR valves in an internal combustion engine. More specifically, the present invention relates to a design for a baffle assembly for confining the ingress of water contaminants into an EGR vent.

Exhaust gas recirculation (EGR) valves are known in the art. Generally, they restrict the exhaust gasses back into the cylinders for lowering nitrogen oxide emission levels caused by high combustion temperatures. Typically, exhaust gas recirculation valves include holes in the base thereof for intake when necessary. Because of the necessity of these vent holes, the positioning of the EGR valve in the engine compartment must be considered. Particularly, if the EGR valve is positioned too close to conditions which would cause water, road slurry and the like to enter the EGR valve, it may cause failure of the EGR valve. Of course, this is an undesirable condition. Typically in the past, EGR valves have been readily placed in positions of the engine compartment which do not receive very much road splash or the like. Therefore, there have been no problems with EGR valves in the past. However, in today's market where redesigns of engine compartments and components are desirable for both cost savings and weight reductions, there has been interest in placement of EGR valves in other than ideal locations, in order to accommodate size, weight and manufacturing conditions. Therefore, there is a need in the art to provide EGR valves which are improved such that placement of the EGR valve is less critical.

SUMMARY OF THE INVENTION

In accordance with the present invention, there is provided an EGR system having a single intake tube and a baffle assembly, for that tube. The baffle assembly includes a first baffle portion and a second over flow vent portion. A cover portion is included for preventing ingress of contaminants from above, and the baffle portion prevents contaminant ingress from below.

The EGR system of the present invention readily provides for venting of an EGR valve in a harsher environment where road splash may be evident. The EGR valve breather assembly blocks the ingress of contaminants from the lower end by way of a baffle assembly. Any splash or road debris which comes from above the baffle assembly is guarded by an upper cover portion which prevents inflow from water from above.

DETAILED DESCRIPTION OF THE PREFERRED EMBODIMENTS

Figure 1:
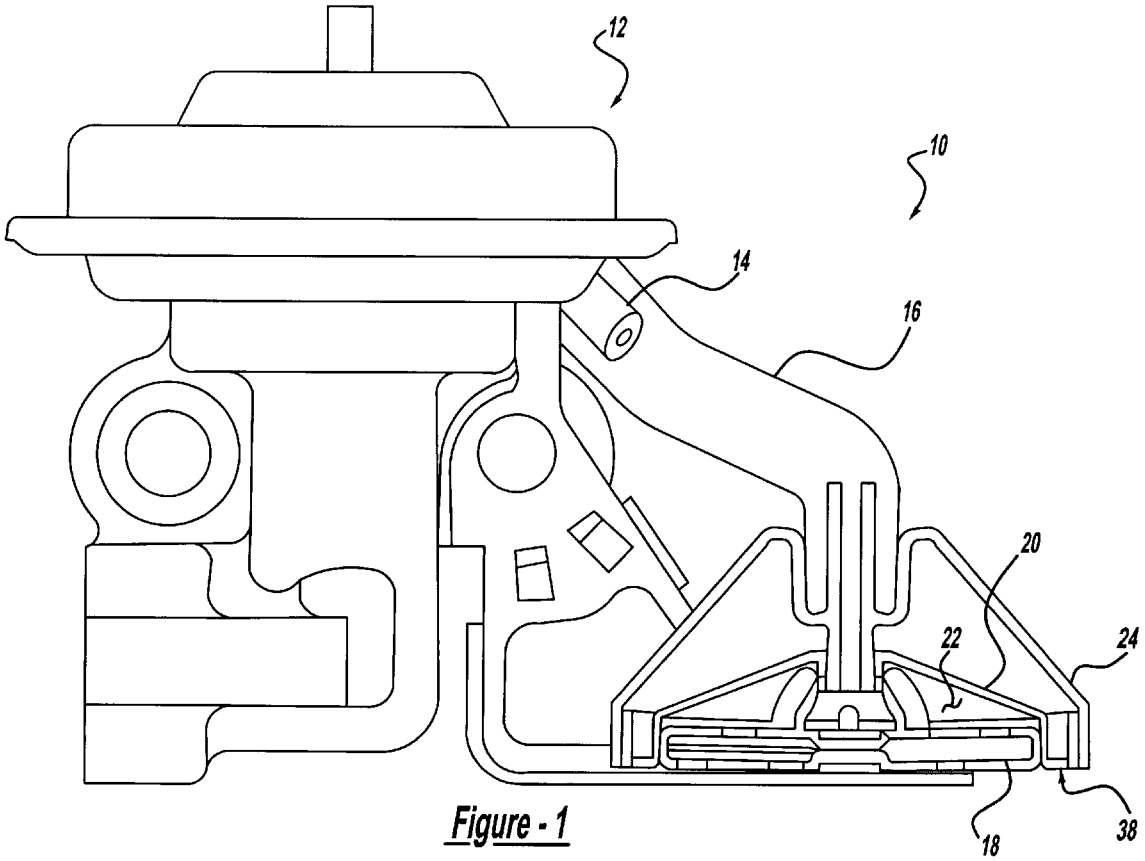
FIG. 1 is a plan view partially broken away of the vacuum breather assembly shown in use on a single vent EGR valve.
Figure 2:
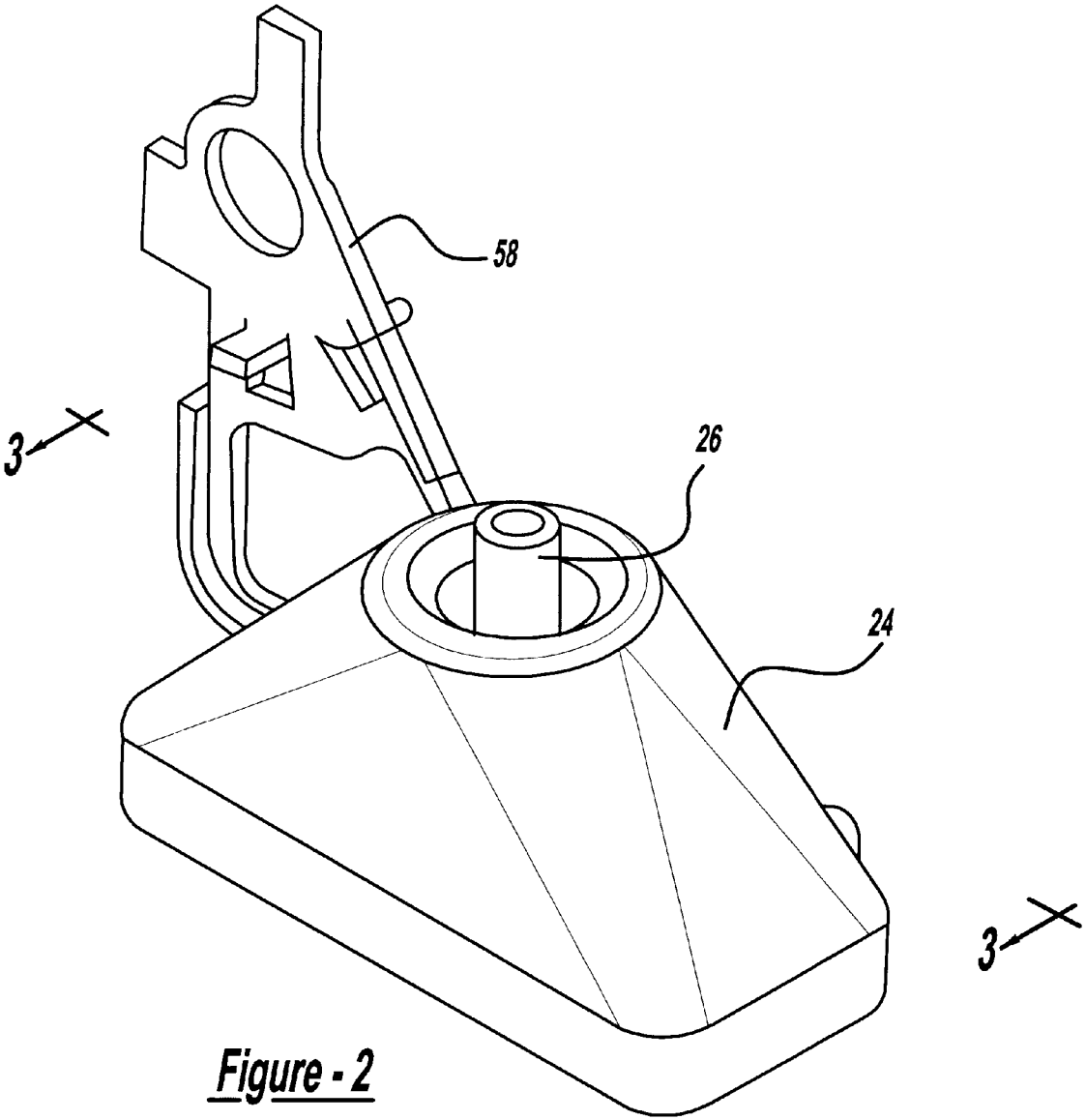
FIG. 2 is a perspective view of the vacuum breather assembly shown in FIG. 1.
Figure 3:
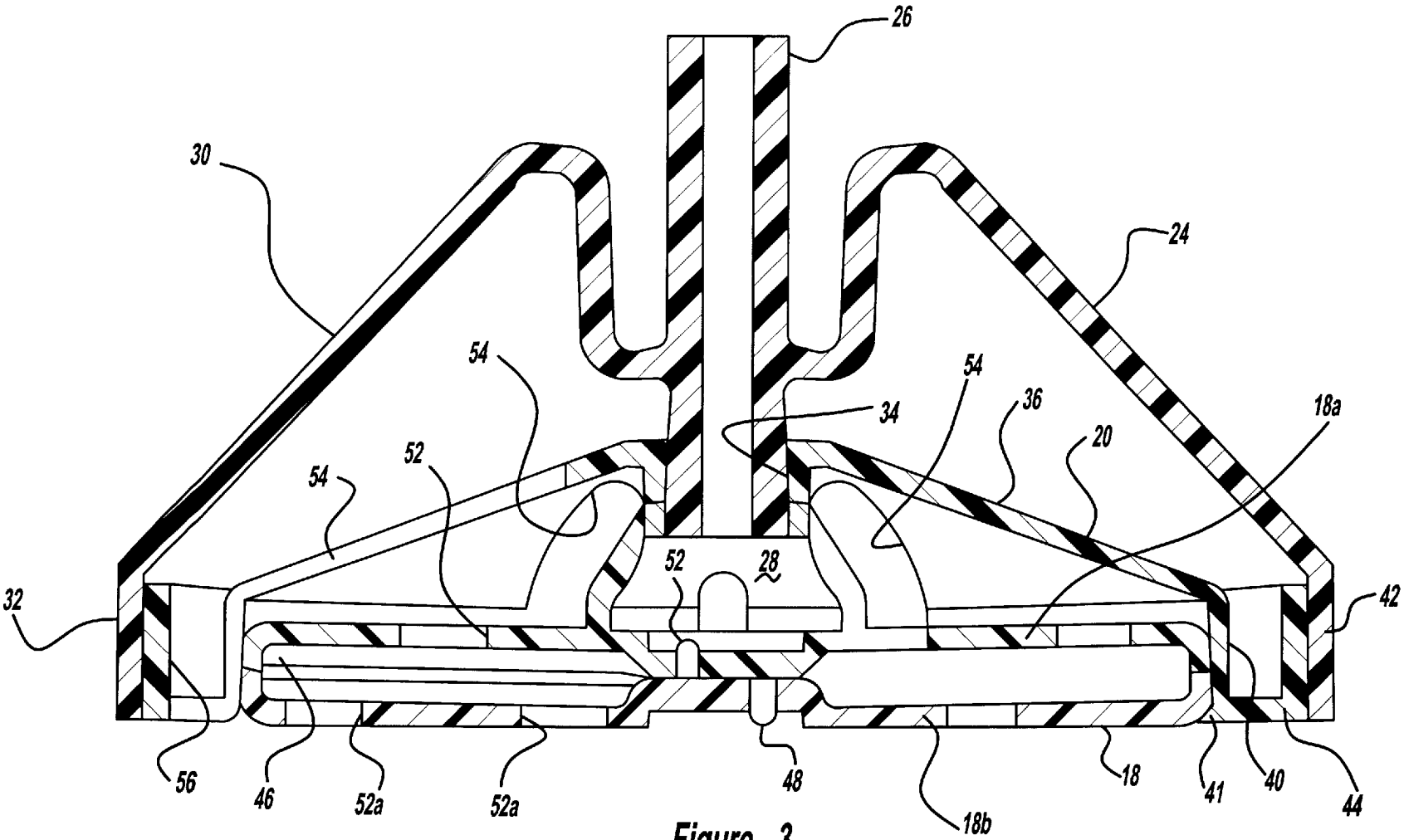
FIG. 3 is a sectional view of the baffle assembly of FIG. 2 taken along line 3—3 of FIG. 2.
Figure 6:
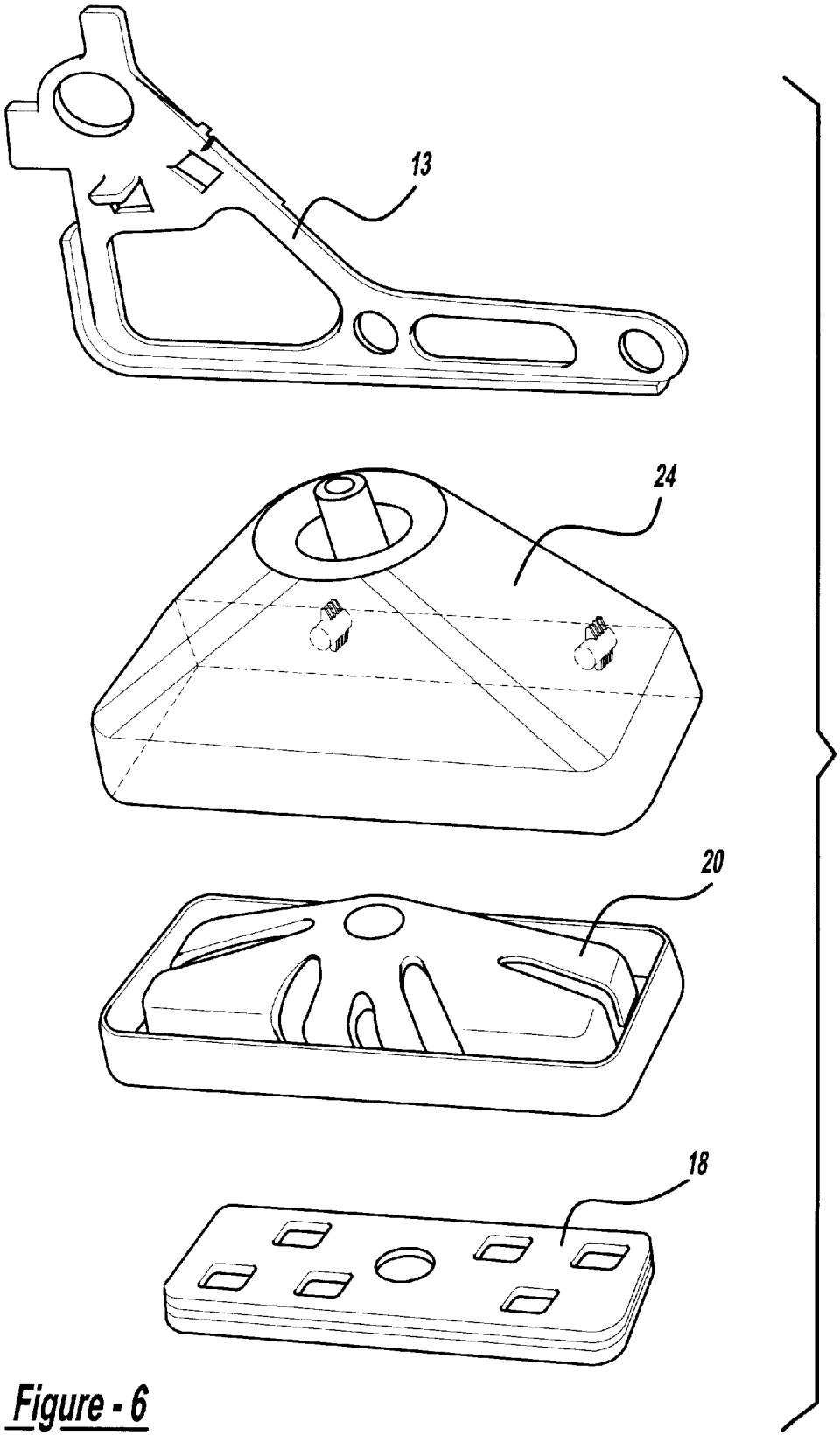
FIG. 6 is an exploded view of the assembly of FIG. 3.

Thus in accordance with the present invention, there is provided a baffle assembly generally shown at 10. In the present invention, the baffle assembly 10 is connected to an exhaust gas recirculation valve (EGR), generally shown at 12 by way of a bracket 13. The EGR valve 12 has a single air inlet 14 and is attached to the baffle assembly 10 via a tube 16. Referring now to FIGS. 2, 3 and 6, the baffle assembly 10 generally includes a first baffle portion 18 which stops egress of water from the underside. A second overflow vent portion 20 is above the baffle portion. The second overflow vent portion defines an intake chamber 22. A shroud portion 24 is provided for protecting the baffle assembly 10 from water egress from above.

The shroud 24 includes a tube connection portion 26, which connects to the inner chamber 28. The shroud portion 24 includes a slanted wall 30, which leads to a down-turned portion 32. The overflow vent portion 20 includes a vertical central orifice 34, for engaging the outside of the tube 26. A sloped wall member 36 terminates in a U-shaped leg member 38. The U-shaped leg member 38 has a first down-turned leg 40 and an up-turned leg 42 separated by the intermediate leg 44. Baffle portion 18 includes outer surfaces 46 which engage the leg 40, securing the baffle 18 to the overflow vent portion 20. Inwardly extending protrusions 41 may be provided on leg 40 for securing the baffle portion 18 to the overflow vent portion 20.

The baffle portion 18 is a two-piece assembly with a upper half 18*a* and a lower half 18*b*. The upper 18*a* and lower 18*b* halves are held together by locking protrusion 48 and 50. Each half has a series of staggering orifices 52 and 52*a*, which act to block the inflow of contaminants into the baffle portion 18. The overflow vent portion 20 includes a series of outwardly extending overflow vents 54 which extend into drain area 56 in the U-shaped portion 38. The overflow vents 54 allow any moisture or contaminants which get by the baffle portion 18 and enter chamber 28 to be dissipated via way of the peripheral drain area 56. The outer shroud 24 guards the inner chamber 28 from any ingress of water from the upper part of the baffle assembly 10. Preferably, the shroud 24 and the overflow vent portion 20 are pyramidal or cone-shaped. The walls are at different angles such that a space is provided between the shroud 24 and vent portion 20.

In operation, therefore, the EGR valve is connected directly to the protected chamber 28. Chamber 28 is protected against direct inflow of contaminants from below by the baffle portion 18. Any contaminants which do get into the chamber 28 dissipate through the drain area 56. The chamber 28 is protected by the shroud portion 24 from above.

Figure 4:
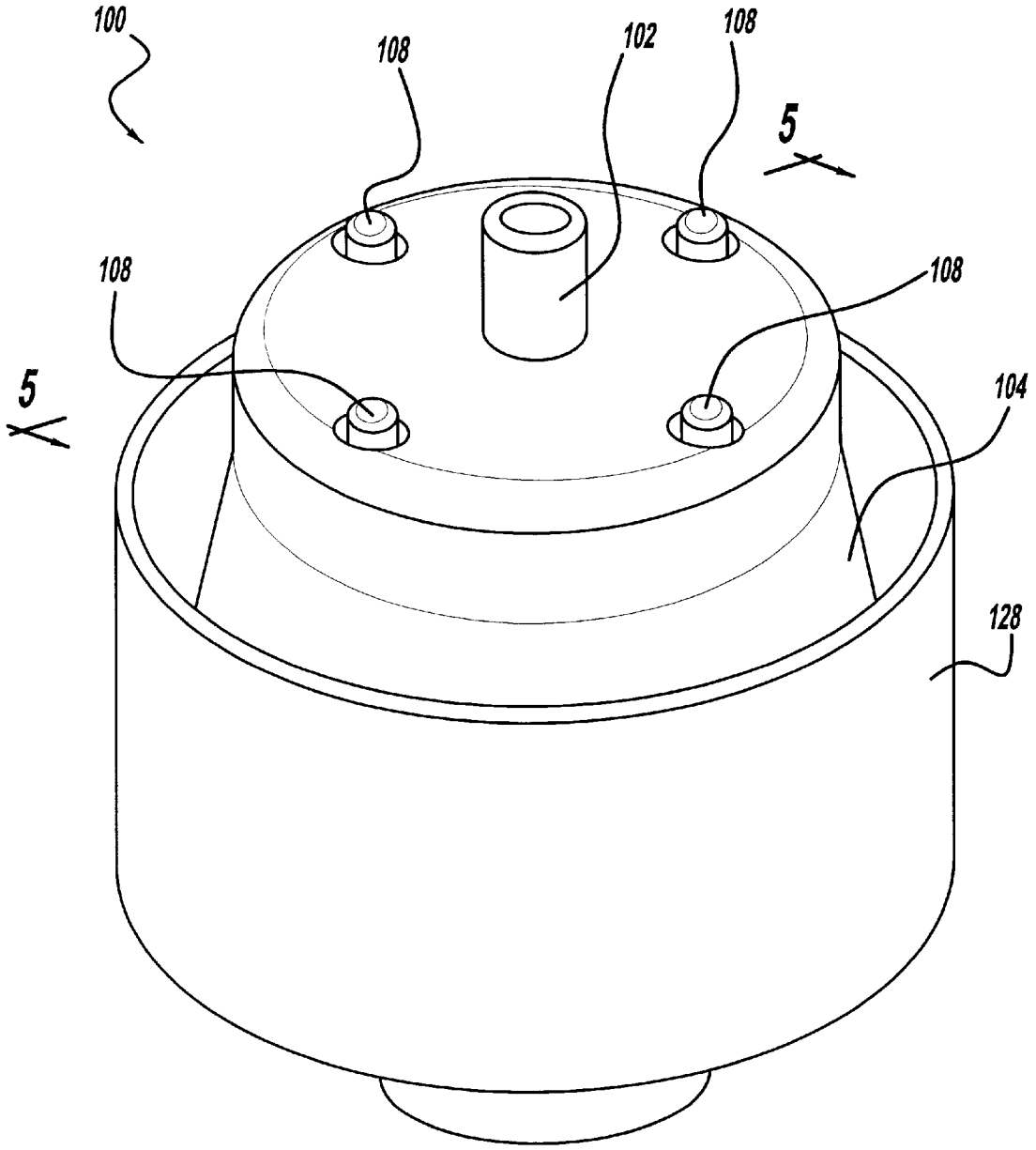
FIG. 4 is a perspective view of and alternate embodiment of a vacuum breather assembly of the present invention.
Figure 5:
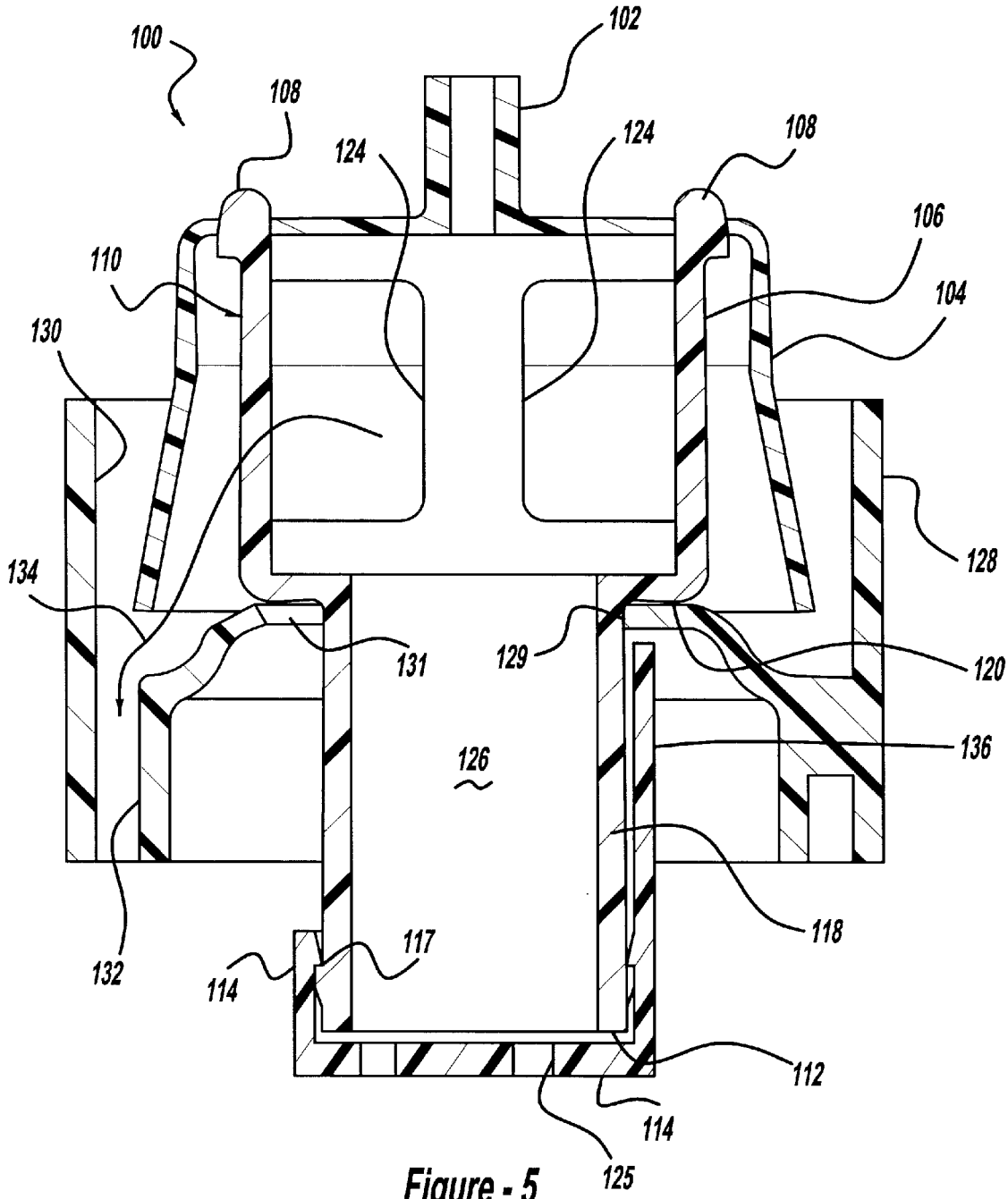
FIG. 5 is a sectional view of the vacuum breather assembly of FIG. 4 taken along line 5—5 of FIG. 4.
Figure 7:
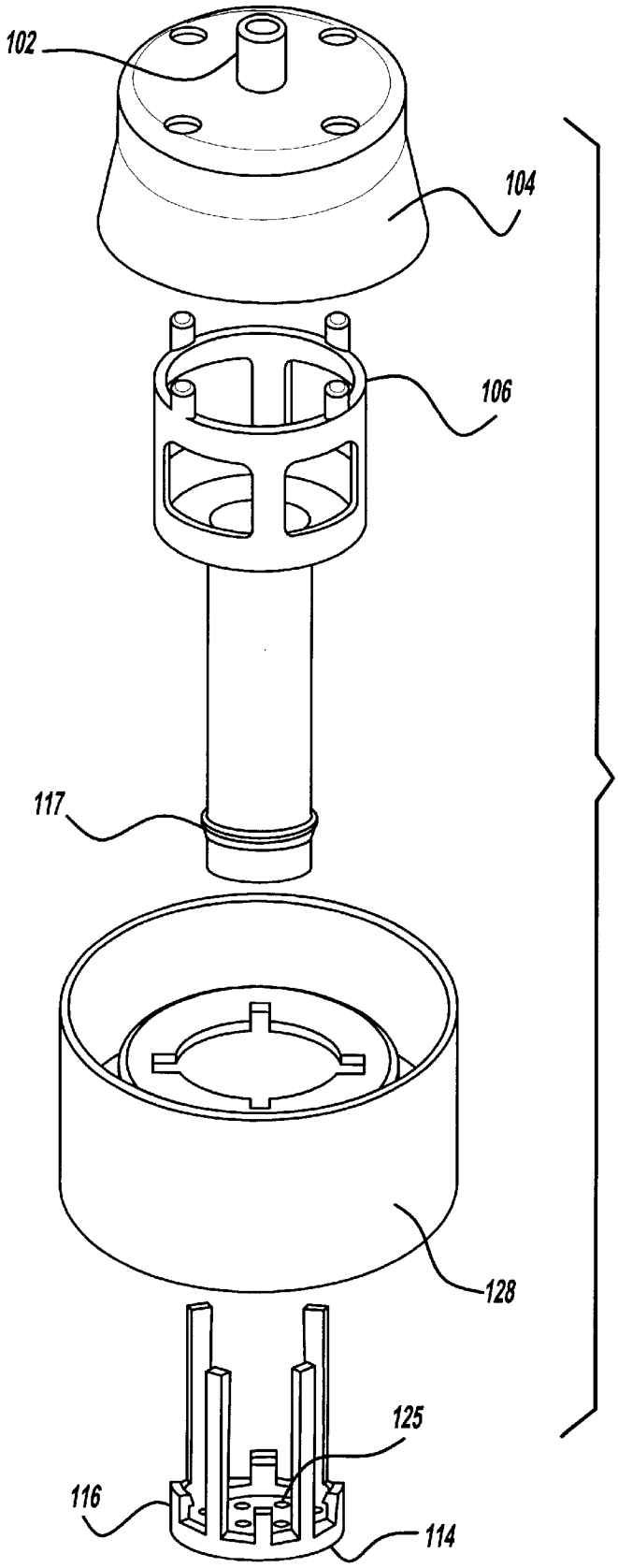
FIG. 7 is an exploded view of the assembly of FIG. 4.

Referring now to FIGS. 4, 5 and 7, in accordance with an alternate embodiment, there is shown a baffle assembly 100. Baffle assembly 100 includes a central connection member 102, which connects to an intake member 104. Intake member 104 is roughly bell-shaped with a cylindrical wall attached to a frusto-conical walled portion. An inner tubular member 106 is affixed to the intake member via locking protrusions 108. The locking protrusion secures the intake member either by a snap fit arrangement or by heat staking or the like. The inner tubular member 106 is fixed to the bell 104 at a first end thereof, generally indicated at 110, and has a second lower end of said inner tubular member 106, generally indicated at 112. A vented end cap 114 is provided for securing the second end 112 from direct ingress of water. The end cap 114 is held into place via spring clips 116 which engage a locking shelf 117 on inner tubular member 106. The inner tubular member 106 includes an enlarged portion, which necks down to a smaller portion 118 at the second end. A shoulder portion 120 is formed between the upper portion 122 and the lower portion 118. The upper portion 122 includes a series of vents 124. These vents allow any water or the like which is trapped in the intake chamber 126 to dissipate. An upstanding outer peripheral wall member 128 is provided, which has a central opening 129 for sliding over the lower portion 118 of the inner tubular member 106 vent aperture 131. Portion 128 includes an upstanding wall 130 which overlaps adjacent to the bell portion 104. Lower drain passageways 132 are provided such that any water which splashes over the top portion of the baffle member drains out thru drain passageway 132. Likewise, any water which backs up into the inner chamber 126 dissipates through holes 124 or holes 125 in the cap 114, through the passageway 132, in order to dissipate water therein as shown by the floor path 134. A series of stop members 136 are utilized for holding the outer member 128 onto the smaller portion 118 of the inner tubular member 106 at the shoulder portion 120.

Thus, in accordance with the present invention, a single vented EGR valve may be placed in other more contaminant prone portions of the engine compartment.

Those skilled in the art can now appreciate from the foregoing description that the broad teachings of the present invention can be implemented in a variety of forms. Therefore, while this invention has been described in connection with particular examples thereof, the true scope of the invention should not be so limited, since other modifications will become apparent to the skilled practitioner upon a study of the drawings, specification and following claims.

What is claimed is:

1. In an EGR vent system having an intake tube, a baffle assembly comprising:

a first baffle portion;

a second overflow vent portion; and a shroud portion for preventing egress of contaminants from above.

2. The baffle assembly of claim 1 wherein said second overflow vent portion defines a protected intake chamber.

3. The baffle assembly of claim 2 wherein said chamber is protected from ingress of contaminants by said baffle portion and said shroud portion.

4. The baffle assembly of claim 3 wherein said second overflow vent portion is sealed at a first end by said baffle portion.

5. The baffle assembly of claim 1 wherein said overflow vent portion and said shroud portion include outwardly tapered walls such that a second chamber is formed between said overflow vent portion and said shroud.

6. The baffle assembly of claim 5 wherein said shroud and said overflow vent portion are pyramidal in shape, having walls with different angles for forming said second chamber.

7. The baffle assembly of claim 5 wherein said shroud and said vent portion are conical with the walls of said shroud portion having a greater angle than walls of said overflow vent portion for forming said second chamber.

8. The baffle assembly of claim 6 wherein said vent portion includes a lower peripheral edge with a shaped channel formed on its lower peripheral edge.

9. The baffle assembly of claim 8 wherein said lower shaped channel includes an inner leg and an outer leg, wherein the inner leg secures said baffle portion in a snap fit arrangement and said outer leg secures said shroud to said vent portion in a snap fit arrangement.

10. A baffle assembly for an EGR inlet of a vehicle comprising:

an inlet tube in communication with an inlet chamber;

an outer shroud for guarding against influx of materials from a first direction;

said chamber defined between a vented upper portion and a vented lower portion; and an overflow chamber defined between said vented upper portion and said outer shroud, and including a drain for draining any liquid trapped therebetween.

11. The baffle assembly of claim 10 wherein said lower portion has an upper wall and a lower wall with staggered openings therebetween.

12. The baffle assembly of claim 11 wherein the vented upper portion has a downwardly extending edge, and said lower portion has an outer peripheral edge, said downwardly extending edge engaging said outer peripheral edge.

13. The baffle assembly of claim 12 wherein a drain hole is formed outboard of the outer peripheral edge.

14. A baffle for an intake for an EGR valve comprising:

an intake portion having a tube for connection to an intake of an EGR valve;

an inner tubular member affixed inside the intake portion at a first end thereof, for forming an intake chamber;

a vented end cap at a second end of said tubular member;

an outer peripheral wall portion extending around said intake portion, said wall portion defining a lower drain for dissipating water from said intake portion;

said inner tubular member including at least one vent hole adjacent said intake portion for dissipating water from said intake chamber to said lower drain.

15. The baffle of claim 14 wherein said intake portion includes a downwardly extending wall which is slanted outward for providing an outwardly extending skirt for directing water to flow away from the vent holes toward said lower drain.

16. The baffle of claim 15 wherein said intake portion is a bell-shaped member having a cylindrical wall and a frusto-conical wall.

17. The baffle of claim 15 wherein said inner tubular member includes an upper enlarged portion and a lower portion and a shoulder portion connecting the enlarged portion and the lower portion, said outer peripheral wall portion including an upwardly extending outer peripheral wall which extends above a lower most portion of said downwardly extending wall.

18. The baffle of claim 17 wherein said downwardly extending wall of said intake portion extends below and radially spaced from said shoulder portion of said inner tubular member.

19. The baffle of claim 17 wherein said outer peripheral wall portion includes a radially inwardly extending portion including surfaces forming an opening therein for engaging the lower portion of said inner tubular member and abutting said shoulder portion.

20. The baffle of claim 19 wherein said lower portion includes a locking shelf said end cap including a locking arm for cooperating with said locking shelf for locking said end cap onto said inner tubular member, said end cap including at least one upwardly extending stop member for abutting against said radially inwardly extending portion of said outer peripheral wall member for securing said outer peripheral wall member to said inner tubular member.

21. The baffle of claim 19 wherein said inwardly extending portion includes drain orifices therein.

* * * * *

UNITED STATES PATENT AND TRADEMARK OFFICE

CERTIFICATE OF CORRECTION

PATENT NO. : 6,491,031 B2
DATED : December 10, 2002
INVENTOR(S) : Mark A. Duda et al.

It is certified that error appears in the above-identified patent and that said Letters Patent is hereby corrected as shown below:

Title page,
Item [56], References Cited, U.S. PATENT DOCUMENTS, "4,373,496" should be -- 4,373,495 --.

Column 1,
Line 57, "and" should be -- an --.

Column 3,
Line 60, delete "lower".

Column 4,
Line 56, "shelf" should be -- shelf, --.

Signed and Sealed this

Twenty-seventh Day of July, 2004

JON W. DUDAS
*Acting Director of the United States Patent and Trademark Office*